US011261628B2

(12) United States Patent
Mitchell et al.

(10) Patent No.: US 11,261,628 B2
(45) Date of Patent: Mar. 1, 2022

(54) COLD ROOM LATCH

(71) Applicant: Kason Industries, Inc., Newnan, GA (US)

(72) Inventors: Brett A Mitchell, Newnan, GA (US); Thomas A Thorsen, Wedowee, AL (US)

(73) Assignee: Kason Industries, Inc., Newnan, GA (US)

( * ) Notice: Subject to any disclaimer, the term of this patent is extended or adjusted under 35 U.S.C. 154(b) by 1047 days.

(21) Appl. No.: 15/890,461

(22) Filed: Feb. 7, 2018

(65) Prior Publication Data

US 2018/0245385 A1 Aug. 30, 2018

Related U.S. Application Data

(60) Provisional application No. 62/456,369, filed on Feb. 8, 2017.

(51) Int. Cl.

| | |
|---|---|
| ***E05C 19/00*** | (2006.01) |
| ***E05B 63/24*** | (2006.01) |
| ***E05B 65/00*** | (2006.01) |
| ***E05B 15/00*** | (2006.01) |

(52) U.S. Cl.

CPC ..... *E05C 19/00* (2013.01); *E05B 63/246* (2013.01); *E05B 65/0053* (2013.01); *E05B 15/008* (2013.01); *E05B 15/0053* (2013.01); *E05B 65/0042* (2013.01); *Y10S 292/71* (2013.01); *Y10T 292/57* (2015.04); *Y10T 292/82* (2015.04); *Y10T 292/85* (2015.04)

(58) Field of Classification Search

CPC .... E05C 19/00; E05B 63/246; E05B 65/0053; G05G 5/06; G05G 5/08; F16H 2061/247; Y10T 292/82; Y10T 292/85; Y10T 292/57; Y10S 292/71

USPC ..... 70/92, 140, 465

See application file for complete search history.

(56) References Cited

U.S. PATENT DOCUMENTS 1,463,341 A * 7/1923 Somers ..... E05B 3/06 292/348
1,516,152 A * 11/1924 Dumont ..... E05B 17/0058 292/347
2,207,569 A * 7/1940 Wild ..... E05B 17/08 292/169.14
2,478,589 A * 8/1949 McKenzie ..... E05B 3/02 292/348

(Continued)

*Primary Examiner* — Christine M Mills
*Assistant Examiner* — Faria F Ahmad
(74) *Attorney, Agent, or Firm* — Baker Donelson Bearman Caldwell & Berkowitz PC

(57) ABSTRACT

A lockable latch (8) is disclosed for walk-in cold rooms which includes a lockable strike (10) with an exterior strike assembly (16) and an interior release assembly (17). The exterior strike assembly includes a housing (25) and a rod holder (32) configured to releasably hold a coupling rod (35). The exterior strike assembly also has a metal anti-rotation plate (40) removably coupled to the housing. The interior release assembly includes a turn knob (53), an escutcheon plate (54), and an index washer (55). The turn knob includes two oppositely disposed alignment projections (77) and a radial array of steps (78) which includes four, re-occurring series of three steps. The index washer has a four time re-occurring series of steps (93).

4 Claims, 4 Drawing Sheets

(56) References Cited

U.S. PATENT DOCUMENTS 2,680,638 A * 6/1954 Groeger ..... E05B 65/0053 292/92
2,855,771 A * 10/1958 Berkowitz ..... E05B 65/0053 70/92
2,872,233 A * 2/1959 Bordner, Jr. ..... E05B 65/0053 292/92
2,886,363 A * 5/1959 Blumenthal ..... E05B 65/0053 292/92
2,969,999 A * 1/1961 Herman ..... E05C 1/12 292/92
3,986,410 A * 10/1976 Robinson ..... G05G 5/06 74/527
4,014,573 A * 3/1977 Lehnhoff ..... E05B 1/06 292/347
4,203,622 A * 5/1980 Cook ..... E05B 65/0053 292/1
4,347,758 A * 9/1982 Geil ..... G05G 1/04 74/531
4,428,005 A * 1/1984 Kubo ..... G05G 1/08 200/DIG. 34
4,530,532 A * 7/1985 Fujiya ..... E05B 63/246 292/341.15
4,540,207 A * 9/1985 Klasen ..... E05B 63/246 292/341.17
4,635,977 A * 1/1987 Yamada ..... E05B 65/0053 292/92
5,582,443 A * 12/1996 Finkelstein ..... E05B 13/108 292/202
5,865,050 A * 2/1999 Michaud ..... E05B 63/0065 70/416
6,354,119 B1 * 3/2002 Molzer ..... E05B 13/106 292/336.3
6,526,788 B2 * 3/2003 Finkelstein ..... E05B 65/0053 292/145
6,877,346 B1 * 4/2005 Finkelstein ..... E05B 17/0075 292/92
7,484,390 B1 * 2/2009 Finkelstein ..... E05B 13/002 292/92
7,819,443 B2 * 10/2010 Ryan ..... E05C 3/043 292/336.3
8,100,443 B2 * 1/2012 Talpe ..... E05B 13/005 292/347
8,904,834 B2 * 12/2014 Finkelstein ..... E05B 13/002 70/134
8,919,832 B1 * 12/2014 Lynch ..... E05B 13/005 292/347
9,260,888 B1 * 2/2016 Yun ..... E05B 65/005
9,823,684 B2 * 11/2017 Finley ..... G05G 5/005
10,345,849 B2 * 7/2019 Sinthomez ..... G05G 5/28
10,920,452 B2 * 2/2021 Roup ..... E05C 9/1833
2002/0096893 A1 * 7/2002 Wu ..... E05B 15/0053 292/347
2005/0184538 A1 * 8/2005 Huang ..... E05B 13/004 292/336.3
2006/0144185 A1 * 7/2006 Tsai ..... G05G 1/10 74/527
2007/0119220 A1 * 5/2007 Maquet ..... H01H 9/282 70/212
2008/0197642 A1 * 8/2008 Talpe ..... E05B 13/005 292/336.3
2014/0259958 A1 * 9/2014 Rumble ..... E05B 65/0042 49/506
2014/0312631 A1 * 10/2014 Mitchell ..... E05B 65/0042 292/197
2017/0130485 A1 * 5/2017 Dodge ..... E05B 17/0075
2017/0292774 A1 * 10/2017 Jang ..... F25D 11/00
2019/0041893 A1 * 2/2019 Livolsi ..... G05G 1/082

* cited by examiner

COLD ROOM LATCH

REFERENCE TO RELATED APPLICATION

Applicant claims the benefit of U.S. Provisional Patent Application Ser. No. 62/456,369 filed Feb. 8, 2017 and entitled Cold Room Latch.

TECHNICAL FIELD

This invention relates generally to walk-in freezer latches and particularly to walk-in freezer door and doorframe system latches and strikes capable of fitting different sized walls.

BACKGROUND OF THE INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit from the environment. Since these environments are often used to store valuable contents, such as expensive products and/or large quantities of products, it is typically desirable that the access door(s) can be locked to control and/or restrict access to such contents. For example, to control access, the availability of a keyed locking option may be desirable so that keys can be provided to personnel who are authorized to access the cold-room environment. As another example, to restrict access during certain times, the availability of an alternate or additional locking option may be desirable so that even authorized personnel cannot access the cold-room environment. There may also be other reasons to control and/or restrict access to walk-in cold rooms such as safety or maintenance.

A problem associated with the locking of a cold-room door is the possibility that a person may become locked within the cold-room. To resolve this potential problem lock strikes have been designed to be mounted to the wall by a fastener extending through the cold-room wall having a threaded rod threaded into the strike and a knob accessible to one on the inside of the cold-room. The unthreading of the fastener from the strike causes the strike to fall off the wall and be disengaged from the locking mechanism. A problem with this type of device is that if one overly tightens the fastener it may become difficult for the person trapped within the cold-room to turn and release it from the strike. Also, a person unfamiliar with the product may not realize that turning the internal knob releases the strike and allows egress from the cold-room. People with limited or impaired use of their hands may have trouble twisting or turning the knob in order to release it from the door.

Accordingly, it is seen that a need exists for a lockable strike for walk-in cold rooms that is strong yet allows easy release from the wall and adjustability for varying wall thicknesses. It is to the provision of such therefore that exemplary embodiments of the present invention are primarily directed.

DETAILED DESCRIPTION

Figure 1:
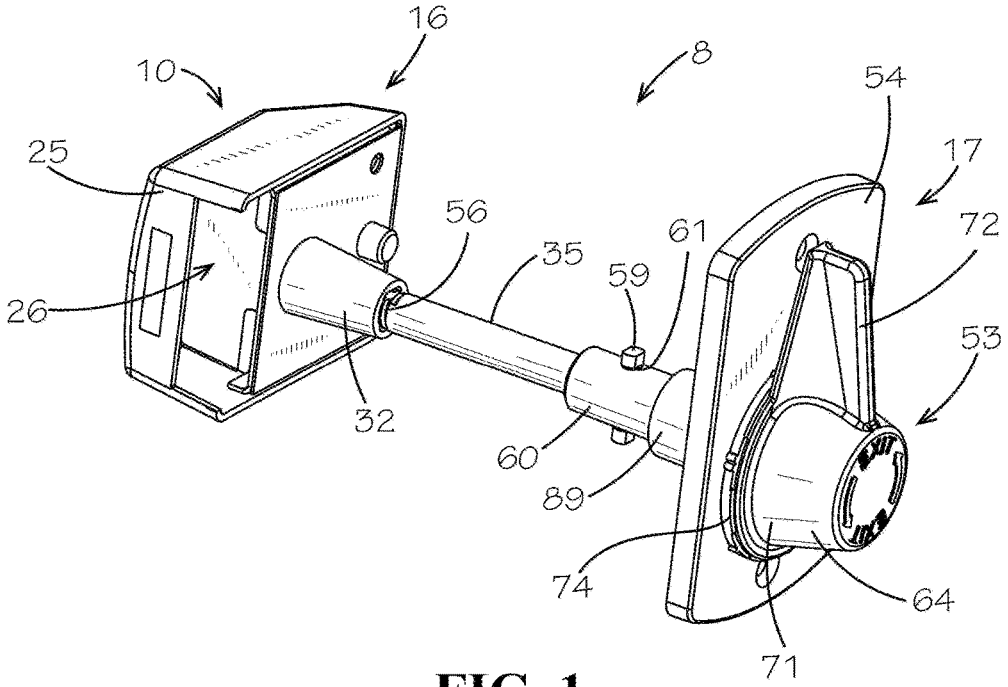
FIG. 1 is a perspective view of a latch of a walk-in freezer door and doorframe that embodies the invention in a preferred form.
Figure 2:
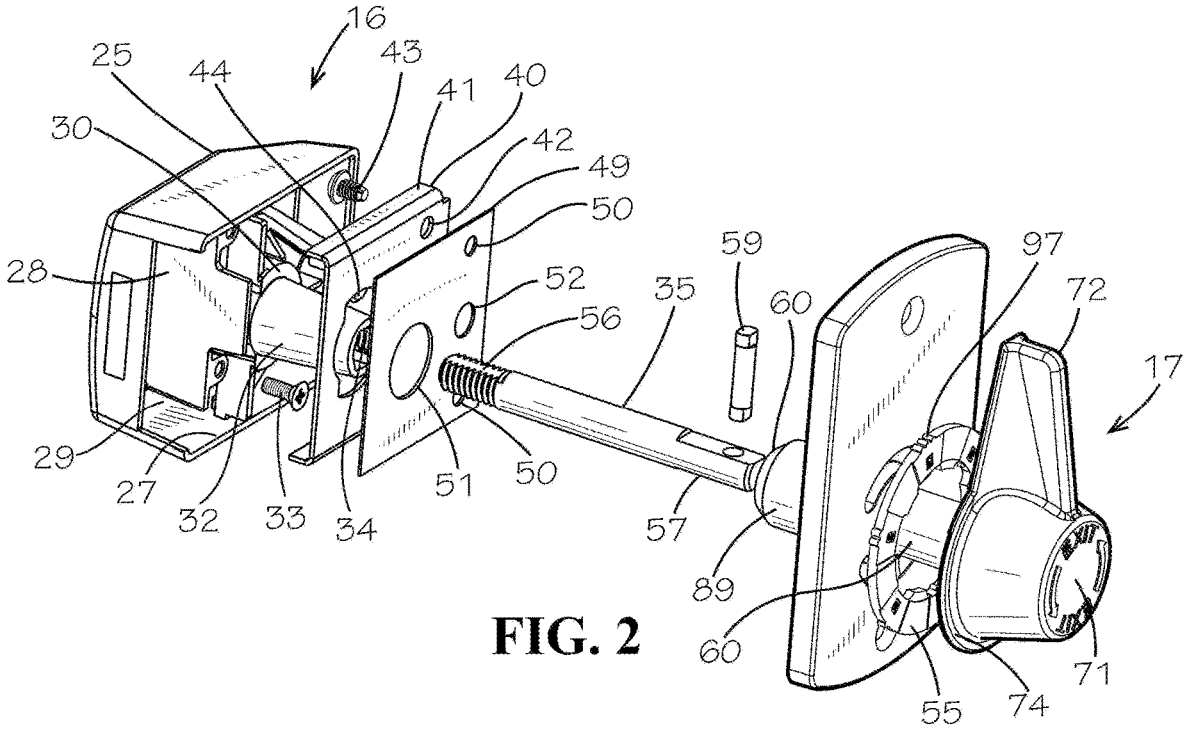
FIG. 2 is an exploded, perspective view of the latch of FIG. 1.

With reference to the drawings, there is shown a lockable latch 8 for walk-in cold rooms according to the present invention. The latch 8 includes lockable strike 10 used in conjunction with a locking handle 11 attached to a door 12 of a walk-in cold room within a surrounding wall 13 to control and/or restrict opening of the door 12 and access the walk-in cold room. The lockable strike 10 includes an exterior strike assembly 16 and an interior release assembly 17. The exterior strike assembly 16 is configured to be mounted to the exterior surface of the cold room wall 13 adjacent the door. The interior release assembly 17 is designed to be mounted to the interior surface of the cold room wall 13 adjacent the door.

The cold room wall 13 has a strike rod through hole or passageway 20 therethrough. The exterior surface of the wall has a detent hole 21 therein which extends approximately ½ inch into the wall. Similarly, the interior surface of the wall has a detent hole 22 therein which extends approximately ½ inch into the wall.

The exterior strike assembly 16 includes a metal cover or housing 25 having a bolt opening 26 and a pair of internal beveled mounting flanges 27. The housing 25 also has an interior mounting wall 28 with two screw mounting holes 29 therein. The exterior strike assembly 16 also includes a metal rod receiver 30 having a rod holder 32 coupled to the interior mounting wall 28 through two mounting screws 33 extending through the rod holder 32 and into mounting screw holes 29. The rod holder 32 has a central passage 34 configured to receive and releasably hold a pinned coupling rod 35, described in more detail hereinafter. The rod holder central passage 34 has a generally circular, internally threaded central portion 36 and two oppositely disposed spacer portions 37 extending outwardly from the central portion 36.

The exterior strike assembly 16 also has a metal mounting or anti-rotation plate 40 removably coupled to the housing 25. The anti-rotation plate 40 includes two oppositely disposed beveled flanges 41 that fit within the confines of the interior of the housing 25 and releasably mate with the mounting flanges 27 of the housing 25. The anti-rotation plate 40 also has two mounting holes 42 therethrough through which threaded mounting screws 43 extend and are threaded into the wall 13. Lastly, the anti-rotation plate 40 has a rod holder opening 44 and a detent 45.

The exterior strike assembly 16 also includes a rubber gasket 49 having mounting holes 50 therethrough aligned with anti-rotation plate mounting holes 42 for the passage of mounting screws 43. The gasket 49 also has a rod holder opening 51 and a detent opening 52, which are aligned with anti-rotation plate opening 44 and detent 45, respectively.

Anti-rotation plate detent 45 is configured to be received within the gasket detent opening 52, and the exterior wall detent hole 21 to prevent rotation or movement of the external strike assembly 16 relative to the wall 13.

The interior release assembly 17 includes the previously identified pinned coupling rod 35, a turn knob 53, a knob mounting or escutcheon plate 54, and a spacer or index washer 55. The coupling rod 35 includes an oblong threaded end 56 and an oblong mounting end 57. The term oblong is intended to represent a cylindrical shape with two oppositely disposed side portions removed, as depicted in the drawings. The threaded end 56 is partially threadably received in central passage 34 of rod holder 32.

The turn knob 53 includes a tubular rod receiver 60 which has a set pin mounting hole 61 which aligns with a set pin mounting hole 58 in the coupling rod mounting end 57 so that a set pin or dowel 59 is positioned through the set pin mounting holes 58 and 61 and then deformed to prevent disengagement of the rod 35 from the knob 53. The rod receiver 47 extends to a gripping portion 64.

The tubular rod receiver 60 has a central channel 66 which extends from the open end almost completely through the knob 53 so that an elongated air chamber 67 is formed between the knob 53 and the end of the rod 35. The turn knob 53 is made of a glass filled polycarbonate material which acts as a thermal insulator.

The turn knob gripping portion 64 includes a truncated conical hub or central portion 71 and a lever or lever portion 72 extending radially outward from the central portion 71. The central portion 71 also has a peripheral flange 74 having an indicator marking 75 thereon in the form of a bump or ridge.

Figure 3:
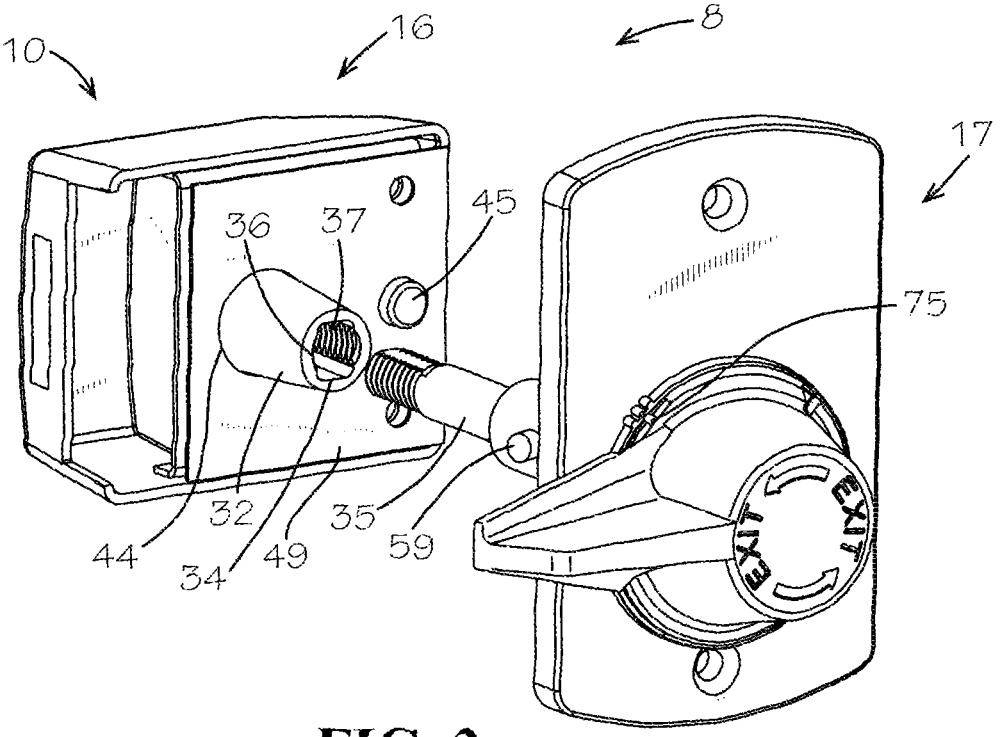
FIG. 3 is a partially exploded, perspective view of the latch of FIG. 1.
Figure 5:
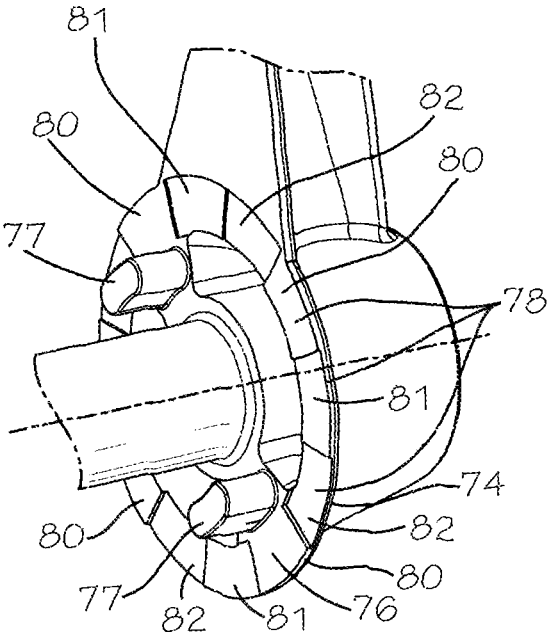
FIG. 5 is a perspective view of a turn knob portion of the latch of FIG. 1.
Figure 6:
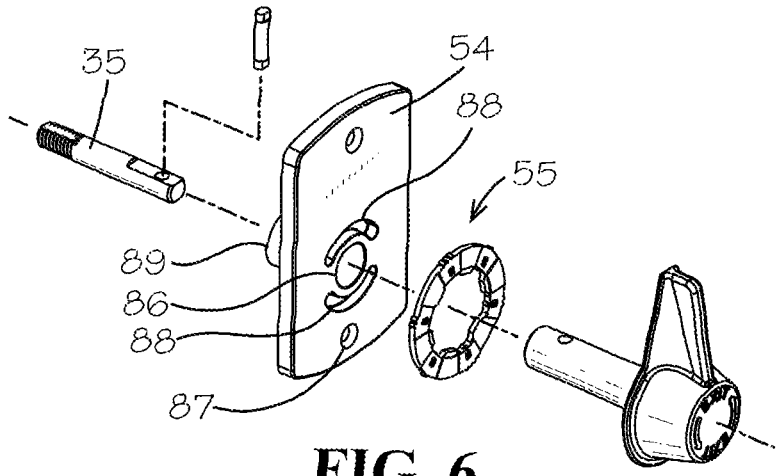
FIG. 6 is a perspective view of portions of the latch of FIG. 1.
Figure 7:
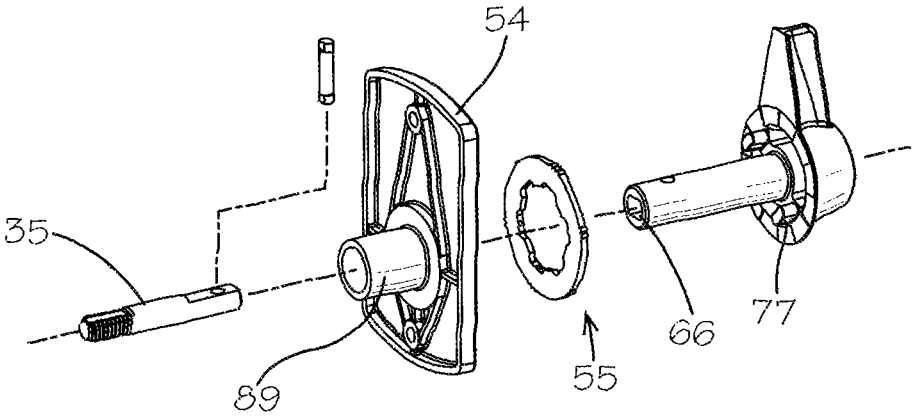
FIG. 7 is a perspective view of an index washer portion of the latch of FIG. 1.
Figure 8:
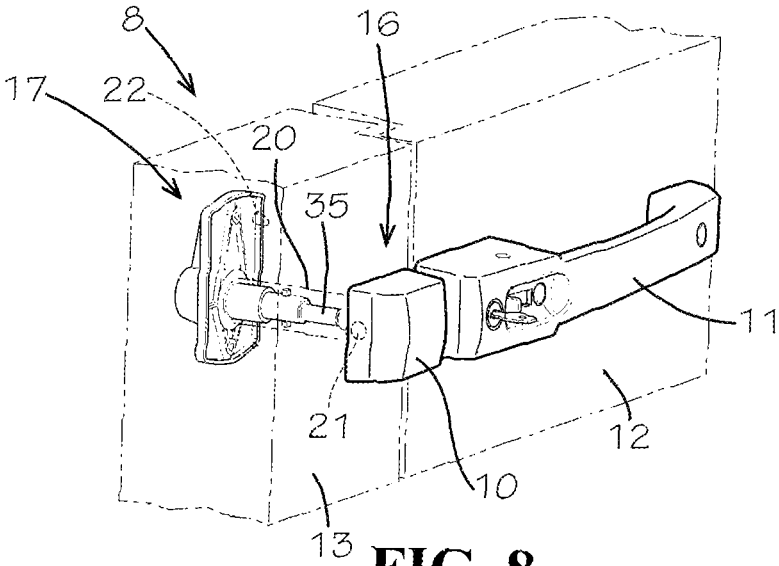
FIG. 8 is a perspective view of the latch of FIG. 1, shown mounted to a door and wall.
Figure 9:
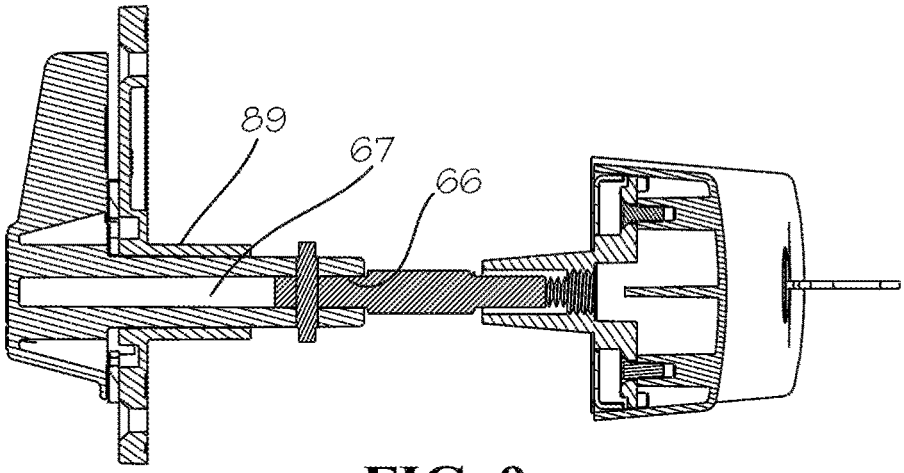
FIG. 9 is a cross-sectional side view of the latch of FIG. 1.
Figure 10:
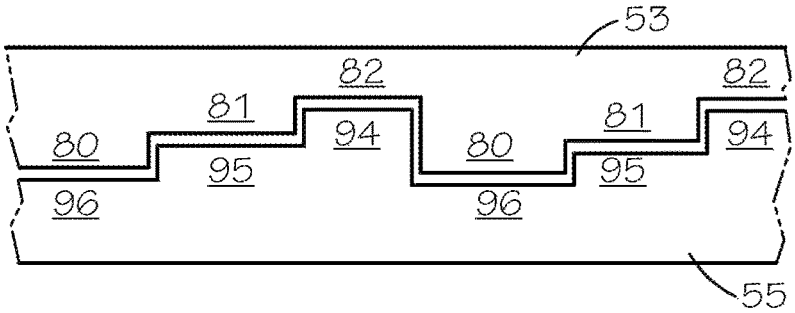
FIGS. 10-12 are a series of views showing a portion of the turn knob and indexing washer of the latch of FIG. 1, showing conceptional side views of the three relative positions therebetween as if the periphery of these round components were linear.

The turn knob door facing surface 76 includes two oppositely disposed alignment projections 77 and an integral, radial array of steps 78. The radial array of steps 78 include four, re-occurring series of three steps (four, re-occurring or repeating series of three progressively taller or higher sized steps). The four first or highest steps 80 include the two steps directly adjacent the two alignment projections 77 and the two additional highest steps 80 offset from those steps by 90 degrees, i.e. the highest steps 80 are those set at clock positions 12, 3, 6, and 9, wherein 12 o'clock is directly adjacent an alignment projections 77. The four middle or medium steps 81 are directly adjacent the highest steps 80 in the clockwise direction in FIG. 5 and are set at the clock positions 1, 4, 7 and 10 o'clock. The next four steps in the clockwise direction are considered the lowest steps 82 and are set at clock positions 2, 5, 8 and 11 o'clock. The indicator marking 75, as shown in FIG. 3, is shown aligned with the highest step 80 just offset from the lever 72.

The escutcheon plate 54 has a generally round rod receiver opening 86, a pair of screw mounting holes 87, and a pair of curved or arcuate projection guide slots 88. The side of the escutcheon plate facing the door also has a tubular rod receiver guide 89 configured to receive the rod receiver 60 of the knob 53.

Figure 4:
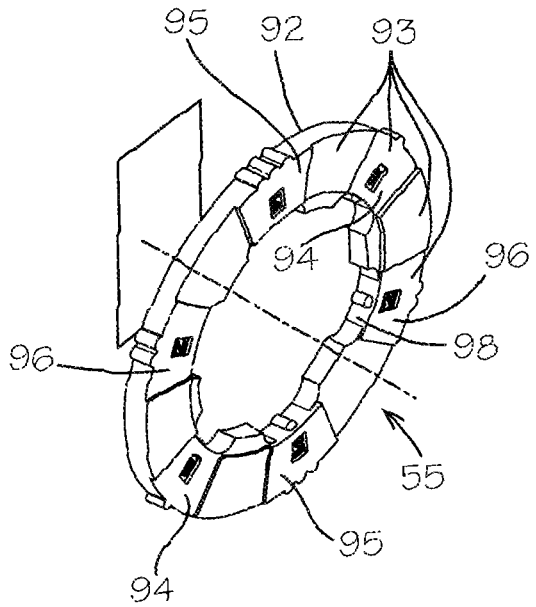
FIG. 4 is a perspective view of an index washer portion of the latch of FIG. 1.

The index washer or adjustable spacer 55 is positioned between the turn knob 53 and the escutcheon plate 54. The adjustment spacer 55 has a smooth, one level door facing surface 92 and an oppositely disposed multi-leveled, four time re-occurring integral series of steps 93 (four, re-occurring series of three progressively taller or higher sized steps). The series of steps 93 include four thickest or highest steps 94 oriented 90 degrees from each other, four middle or medium steps 95 adjacent to the highest steps 94 in the clockwise direction in FIG. 4, and four thinnest of lowest steps 96 adjacent to the middle steps 95 in the clockwise direction. Thus, the steps are progressively decreasing in height commencing with highest step 95 in the clockwise direction shown in FIG. 4, and therefore progressively increasing in height commencing with lowest step 96 in the counterclockwise direction.

The peripheral outside edge of the adjustable spacer 55 includes indexing markers 97 in the form of bumps or ridges. The highest steps 94 are aligned with the markers 97 have three ridges, the middle steps 95 are aligned with the markers 97 having two ridges, and the lowest steps 96 are aligned with the markers 97 having one ridge. The inside edge of the adjustable spacer 55 has a series of recesses or indentations 98 which are configured to receive alignment projections 77 to prevent relative rotation therebetween, and thus the combination of which may be considered to be a retainer. The indentations 98 are aligned along two of the four like leveled steps 93, i.e., two indentations 98 are aligned along two oppositely disposed highest steps 94, two indentations 98 are aligned along two oppositely disposed middle steps 95, and two indentations 98 are aligned along two oppositely disposed lowest steps 96. The steps 93 are configured to correspond with or mesh with the steps 78 of the knob 53.

It should be noted that the lever portion 72 of the knob gripping portion 64 extends radially and has a height (distance from flange 74 along the longitudinal direction of rod 35) which enables one to nudge the lever portion 72 to provide rotation of the knob 53. This enables one who does not have the physical dexterity or capability to rotate a knob the ability to do so.

In use, the gasket 49 is positioned against the outside surface of the cold-room wall 13 and the anti-rotation plate 40 is similarly aligned on the opposite side of the gasket 49. Detent 45 is passed through the gasket detent opening 52 and into the exterior wall detent hole 21 to prevent rotation or movement of the external strike assembly 16 relative to the wall 13. Mounting screws 43 are then passed through mounting holes 42 and 50 and threaded into the cold-room wall 13 to secure the anti-rotation plate and gasket in position. It should be understood that the mounting of the gasket and anti-rotation plate may be done at a factory to provide a more precise fitting than on-site mounting.

The exterior strike assembly housing 25 is then releasably coupled to the anti-rotation plate 40 mounted to the wall 13 by mating the anti-rotation plate beveled flanges 41 with the mounting flanges 27 of the housing 25. The mating between the flanges is considered a loose or releasable fit as the exterior housing 25 is intended to disengage from the anti-rotation plate 40 in an emergency situation. The rod holder 32 passes through the rod holder opening 44 of the anti-rotation plate 40 and through the rod holder opening 51 of the gasket 49, and into the strike rod passageway 20 through the door 12.

With the exterior strike assembly 16 held in place against the exterior surface of the wall, the interior strike assembly 17 is positioned against the wall's interior surface 19. The pinned coupling rod 35 is then extended through the strike rod passageway 20 and into the rod holder central passageway 34. Should the escutcheon plate 54 include a positioning detent, such a detent would also be positioned within the interior detent hole 22. The partially threaded end 56 of the pinned coupling rod 35 is passed into the rod holder 32 where it is then rotated approximately a quarter turn or 90 degrees so that the threaded end 56 threadably meshes with the internal threads of the central portion 36. Rotation of the coupling rod 35 commences with the turn knob 53 in the "release" position and ends with the turn knob 53 in the locked, vertical position.

Now, rotation in the opposite direction in an emergency situation, or back to the release position, causes the threaded end 56 to quickly release from the internal threads of the rod holder central portion 36 wherein the spacer portions 37 allow for the complete release of the threaded end, thereby disconnecting the exterior strike assembly 16 from the rod where the exterior strike assembly housing 25 may then fall from the wall surface, unlocking the door and allowing the door to be opened.

Figure 12:
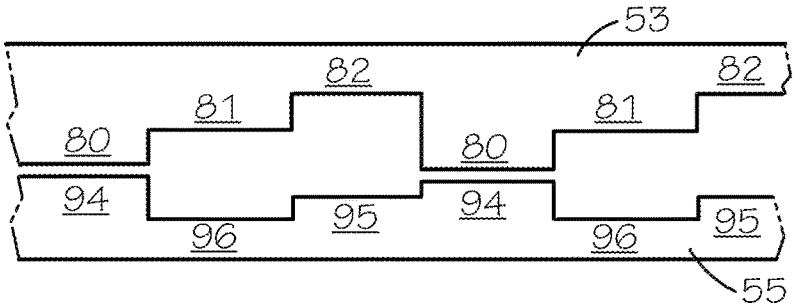

It should be understood that the depth or thickness of the door may vary somewhat. Therefore, the interior strike assembly is provide with adjustment capabilities through the index washer 55 and its cooperation with the configuration of the turn knob, specifically the steps of each of these two components. For example, should a large gap exists as result of the door being thinner, the gap could be noticed between the turn knob 53 and the escutcheon plate 54. To maximize the adjustment in such a circumstance the index washer 55 is coupled to the knob, with the alignment projections 77 set within the corresponding indentations 98, so that its markers 97 associated with the highest step 94 (three ridges) is aligned with the indicator marking 75 on the knob 53. With this alignment, the four highest steps 94 of the index washer 55 are seated against four highest steps 80 of the knob 53 to create the most separation between the index washer 55 and the turn knob 53 and the largest adjustment (combined width) corresponding to the largest gap. In this alignment, only the highest steps 94 of the index washer contact the highest steps 80 of the knob, as shown in FIG. 12.

Figure 11:
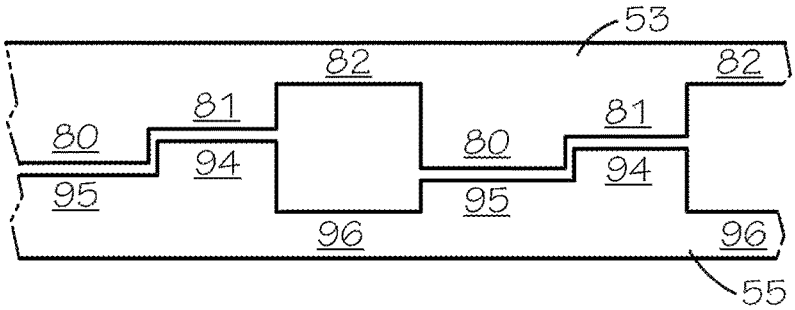

Should a medium sized gap occur, the index washer is positioned with the markers 97 of the middle steps 95 aligned with the marker 75 of the knob. Here, the separation between the index washer 55 and the turn knob is to correct for a medium sized gap. Now, the indexing washer middle steps 95 contacts the knob highest step 80, and the indexing washer highest steps 94 contact the knob middle steps 81, as shown in FIG. 11.

Should a small sized gap occur, the index washer is positioned with the markers 97 of the lowest steps 96 aligned with the marker 75 of the knob. Here, the separation between the index washer 55 and the turn knob is to correct for a small sized gap. Now, the indexing washer lowest steps 96 contact the knob highest steps 80, the indexing washer middle steps 9 contact the knob middle steps 81, and the indexing washer highest steps 94 contact the knob lowest steps 82, i.e., all steps are in contact with opposing steps. In all configurations, the index washer 55 is prevented from rotating by the seating of the alignment projections 77 of the knob with indentations 98 in the index washer.

It should be understood, that the mounting of the alignment projections 77 within the projection guide slots 88 limit the rotation of the knob 53 and thus the coupling rod 35. This feature prevents over-rotation of the coupling rod which may allow for the re-threading of the threaded end 56 onto the threads of the central portion 36.

If a person is accidentally locked within the cold room that person may easily open the door by rotating the lever 90 degrees counter-clockwise, thereby unthreading the threaded end 56 from the central portion 36 or "unlocked" position. The pinned coupling rod 35 may then be extracted completely from the exterior strike assembly 16, thereby causing the exterior strike assembly to drop off the wall through little, if any, outward force upon the door even with the handle 11 in its locked position, i.e., with the handle locking bolt residing within the lockable strike bolt opening 26. With the lockable strike 10 unmounted from the wall, the locking handle 11 can not prevent the door from opening and the person may exit the cold-room through the open door.

It should be understood that the space adjuster allows for a tighter fit of the lockable strike when mounted to the wall. Also, a person may release the lock strike with only a quarter turn of the lever, i.e., a 90 degree turn releases the lockable strike, rather than having to manually unscrew the handle through multiple rotations as described in the prior art.

It should be understood that the foregoing descriptions merely relate to exemplary, illustrative embodiments of the invention. Therefore, it should also be understood that various modifications may be made to exemplary embodiments described herein that are within the scope of the invention, which will be recognized by one of ordinary skill in the art in light of the disclosure herein. Furthermore, various elements of the described exemplary embodiments of the invention may be known in the art or recognized by one of ordinary skill in the art based on the disclosure herein.

The invention claimed is:

1. A cold room latch for a walk-in cold room having a locking handle with a moveable bolt, comprising, an exterior strike housing;

a rod holder coupled to said housing;

a strike mounting plate releasably coupled to said exterior strike housing, a rod releasably coupled to said rod holder;

a turn knob coupled to said rod, said turn knob having an adjustment surface facing towards said strike mounting plate, said turn knob adjustment surface having a plurality of reoccurring knob step sets wherein each knob step set has a plurality of knob steps;

an index washer having a central hole through which extends said rod, said index washer having a plurality of reoccurring index washer step sets wherein each index washer step set has a plurality of index washer knob steps, said index washer being configured to mate with said turn knob at a plurality of different stationary, rotational positions to prevent rotational movement between said index washer and said turn knob, and a knob mounting plate coupled to said index washer oppositely from said turn knob, said rod also passing through an opening through said knob mounting plate, wherein said turn knob includes at least one knob projection, and wherein said index washer includes at least one recess associated with each indexing washer step set of said plurality of reoccurring index washer step sets, each said recess being configured to receive at least a portion of said knob projection.

2. The cold room latch of claim 1 wherein said knob mounting plate includes an arcuate slot configured to receive said knob projection for limited arcuate movement of said knob projection along said arcuate slot.

3. The cold room latch of claim 1 wherein said knob mounting plate includes a tubular receiver guide and wherein said turn knob includes a tubular rod configured to be received within said tubular receiver guide and receive said rod.

4. The cold room latch of claim 1 wherein said turn knob includes a central hub and a lever portion extending radially from said central hub.

* * * * *